US005305770A

United States Patent [19]

DeMarco

[11] Patent Number: 5,305,770

[45] Date of Patent: Apr. 26, 1994

[54] OUTDOOR UMBRELLA

[76] Inventor: Joseph H. DeMarco, 60 Seaman Ave., New York, N.Y. 10034

[21] Appl. No.: 43,756

[22] Filed: Apr. 7, 1993

[51] Int. Cl.[5] ..... A45B 19/06

[52] U.S. Cl. ..... 135/26; 135/25.31; 135/25.33; 135/31; 135/33.2

[58] Field of Search ..... 135/15.1, 33.2, 25.31, 135/25.33, 31, 33.7, 26, 25.32, 25.3, 33.4, 33.41

[56] References Cited

U.S. PATENT DOCUMENTS

| | | | |
|---|---|---|---|
| 212,457 | 2/1879 | Girbardt | 135/33.7 |
| 858,967 | 7/1907 | Dimond | 135/33.2 X |
| 1,628,539 | 5/1927 | Grey | 135/15.1 |
| 3,557,809 | 1/1971 | Vazquez | 135/15.1 |
| 3,732,879 | 5/1973 | Okuda | 135/25.31 X |
| 3,960,162 | 6/1976 | Noel | 135/33.7 |
| 4,674,524 | 6/1987 | DeMarco | 135/26 |
| 5,078,166 | 1/1992 | Lee | 135/33.7 |
| 5,115,827 | 5/1992 | Lee | 135/33.7 |

*Primary Examiner*—Carl D. Friedman
*Assistant Examiner*—Beth A. Aubrey

[57] ABSTRACT

An umbrella which opens into a noteworthy enlarged expanse due to outer fabric-supporting struts being urged through sliding movement along inner fabric-supporting struts, so that the two fabrics cooperate to provide the enlarged expanse to the umbrella.

1 Claim, 1 Drawing Sheet

OUTDOOR UMBRELLA

The present invention relates generally to an outdoor umbrella of the type and size suitable for use in a beach environment or the like, which size should optimally be of a large extent during use and, during non-use or storage of a compact size, and more particularly to improvements for achieving this size differential objective for the umbrella.

EXAMPLE OF THE PRIOR ART

In this crowded art of differential-sized umbrellas, numerous techniques are employed to achieve a compact non-use or storage size that is significantly less than the open or in-use size of the umbrella such as, for example, an interconnected two strut construction of an inner and outer cooperating pair of struts that provide a combined size in the open umbrella condition and approximately one-half size in the closed or storage condition by virtue of the outer strut being folded back on the inner strut. While this technique is appropriate for a typical rain umbrella, it and similar techniques are not appropriate for an outdoor beach umbrella having considerably larger size requirements during use.

Another employed different technique, however, that warrants noting is illustrated and described in U.S. Pat. No. 869,082 issued to J. Hays on Oct. 22, 1907. A cooperating pair of an inner or upper and an outer or lower strut is employed, but the operative connection therebetween is not pivotal, but one in which the outer strut is telescoped in the inner strut. Thus, according to this patent, the open reach of the umbrella is the combination of the lengths of the two struts, while the compact closed size is only the length portion of the upper strut since the lower strut is at this time telescoped within the upper strut. While the size differential would be readily achieved in the operating mode of the two struts as just generally described if only the struts were involved, it is of no apparent utility for an umbrella once, as is required, the struts are attached in supported relation beneath the weather barrier fabric cover of the umbrella. For example, the management of the excess in the form of folds or pleats that is created in the fabric cover when the outer strut is telescoped within the inner strut is a formidable problem in the construction and use of the umbrella, as well as creating an adverse distraction in the appearance of the umbrella.

Broadly, it is an object of the present invention to provide an outdoor umbrella having an optimum differential in its open and closed conditions overcoming the foregoing and other shortcomings of the prior art. More particularly, it is an object to embody a usable size differential in an outdoor umbrella while maintaining a noteworthy simplicity in its construction and operating mode, and additionally achieving a noteworthy appearance for the umbrella.

The description of the invention which follows, together with the accompanying drawings, should not be construed as limiting the invention to the example shown and described, because those skilled in the art to which this invention appertains will be able to devise other forms thereof within the ambit of the appended claims.

Figure 1:
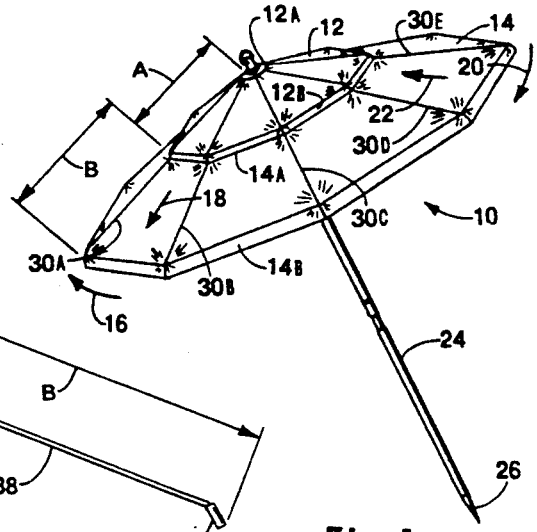
FIG. 1 is a perspective view of the within inventive improved outdoor umbrella shown in its open condition with fabric covers on underlying circumferentially disposed arrangements of support struts.

Shown in FIG. 1 is the within inventive improved outdoor umbrella, generally designated 10, in an open condition in which the umbrella fabric cover, in this instance being two, namely an upper cover 12 and a lower cover 14 are disposed in a covering and supported relation on underlying arrangements of cooperating support struts. The cooperation and operative relationship between umbrella covers and support struts are well understood and are described and illustrated in numerous prior patents, as exemplified by my prior U.S. Pat. No. 4,674,524 issued on Jun. 23, 1987, incorporated in its entirety herein by this reference.

Underlying the present invention is providing the umbrella 10 with an optimum small-size allotment of space for its fabric cover in a closed condition which is convenient for storage, and an increased-sized fabric cover, as illustrated in FIG. 1, in an open condition which is advantageous during use. More particularly, starting from its closed condition umbrella 10 is opened as a result of the support struts or structure being urged through a pivotal traverse 16 resulting in the extent of the fabric cover being the distance A as provided by the upper fabric cover 12, and, in addition, the distance B provided by the fabric cover 14. As will be explained in greater detail subsequently, during the pivotal traverse 16, the support structure and the fabric cover component 14, starting from a position beneath the fabric cover component 12, is urged through radial movement 18, and, in this manner, fabric component 14 thus serves effectively as a radial extension of the fabric component 12. When the umbrella is closed, which occurs when the support structure and fabric components are urged through a reverse direction pivotal traverse as denoted by the arrow 20, the fabric cover component 14 is urged through radial movement 22 back beneath the fabric cover component 12 and, as a consequence, and as will be better understood as the description proceeds, thus provides the umbrella 10 in its closed condition with space allotted for the fabric cover consisting of the dimension A and only a portion of the dimension B, said latter portion more particularly being approximately half of the dimension B.

Figure 2:
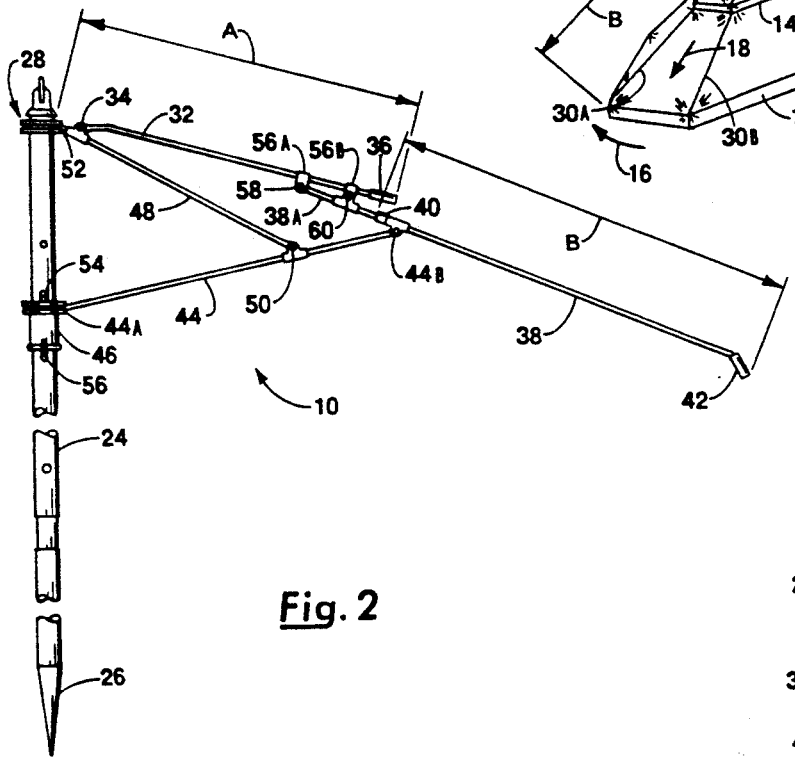
FIG. 2 is a front elevational view, on an enlarged scale, of one of the circumferentially disposed arrangements of support struts in the umbrella open condition for the fabric covers [omitted for simplicity in FIG. 2]
Figure 3:
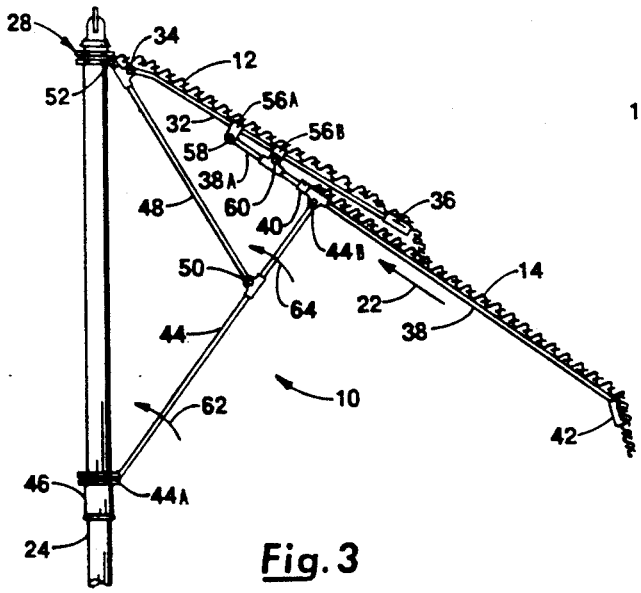
FIG. 3 is a partial view similar to the front elevational view of FIG. 2, but illustrating the support strut arrangement in a partially closed condition.
Figure 4:
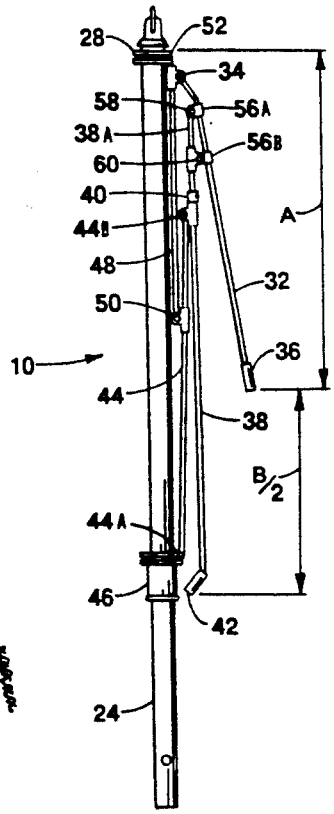
FIG. 4 is a view similar to FIG. 3, but illustrating the support strut arrangement in its closed condition.

In conjunction with FIG. 1, reference should now be made to FIGS. 2–4 which progressively show the cooperation of the support structure arrangement and how it provides the open and closed conditions to the umbrella 10 and the different extents or dimensions of the umbrella fabric covers in accordance with the present invention. In the fully open condition of the umbrella as depicted in FIG. 2, it can be readily noted that the umbrella 10 includes a center pole 24 having at its lower end a pointed configuration 26 for supporting the umbrella 10 in an upright condition in the sand of a beach when it is used in this environment. At its opposite end, center pole 24 is provided, as at the location 28, with a pivot of well understood and known structural features, it being also well understood that at the pivot 28 there is appropriately connected for pivotal traversing movement the support structure arrangement for supporting the umbrella fabric cover. Although for simplicity's sake only one cooperating arrangement of supporting struts is shown in FIG. 2, it will be understood that umbrella 10 in its commercial form is provided with plural circumferentially disposed cooperating sets of supporting struts, the preferred number being eight, of which in FIG. 1 only five are shown at locations 30A, 30B, 30C, 30D and 30E.

Still referring to FIG. 1, in the inventive umbrella 10, as already noted, the total fabric cover is comprised of two cover components 12 and 14. Fabric component 12 is aptly characterized as having a doughnut shape in that it has a central opening bounded by a small diameter circular inner edge 12A and a larger diameter circular outer edge 12B. Also aptly characterized as having a doughnut shape, fabric cover component 14 also has a central opening approximately of the same diameter size as the outer diameter of the fabric component 12 bounded by a circular inner edge 14A and a maximum sized circular outer edge 14B.

For clarity's sake the fabric cover components 12 and 14 have been omitted from FIGS. 2 and 4 and only partially shown in FIG. 3, so as not to interfere with a complete understanding of the cooperation of the support structure arrangement and the operating mode of this support structure. Referring to these drawing figures, umbrella 10 has an upper circumferentially disposed first set of struts individually and collectively designated 32, having at its upper end a pivot connection at 34 and, at its opposite end, an appropriate and well understood fabric clamp 36. Fabric cover component 12 of FIG. 1 will be understood to be attached to a cooperating support strut 32 only at its opposite edges 12A and 12B, a clamp (not shown) being provided for edge 12A adjacent the pivot 28, and for the fabric edge 12B use being made of the clamp 36. In between the attached edges 12A and 12B, fabric cover component 12 is unattached so that there is no interference with sliding or tracking movement along each strut 32, as will be explained in greater detail subsequently.

Umbrella 10 is additionally provided with a lower circumferentially disposed second set of struts, individually and collectively designated 38, clamps 40 and 42 on each strut being used in the attachment in supported relation on the circumferentially disposed struts 38 of the cooperating fabric cover component 14. While in this embodiment of umbrella 10 only the two clamps 40 and 42 are used in attaching the fabric cover component 14, optional use can be made of additional clamps since tracking movement does not occur along the struts 38.

To provide the pivotal traversing movement to the arrangement of struts 32 and 38, use is made of cooperating linkages consisting of a first circumferentially disposed arrangement of links, of which each link 44 is connected adjacent one end 44A so as to partake of pivotal movement during ascending and descending movement of a slide 46 which tracks along the vertical axis of the center pole 24. At the opposite end of each link 44 there is a pivotal connection, as at 44B, to the stationary clamp 40 of each strut 38. Cooperating with each link 44 is another circumferential arrangement of links 48 each connected at one end to partake of pivotal traversing movement at pivot 50 and at its opposite upper end 52 connected to the center pole upper pivot 28. The pivots and the operating mode of these pivots in allowing pivotal traversing movement of the support struts 32 and 38, and also of the links 44 and 48 are so well understood that a description thereof is not deemed necessary in order to provide a full understanding of what is deemed to be the patentable advance over the prior art of umbrella 10, and thus requires only the general reference to these pivots and their operating mode being provided. Also, the omission of this description and illustration is further deemed unnecessary in view of the descriptions and illustrations thereof which are fully set forth in U.S. Pat. No. 4,674,524 incorporated herein by reference.

The operating mode of the umbrella 10 will now be described in conjunction with FIGS. 2–4. Starting with the open umbrella condition of FIG. 2, in which center pole slide 46 is at its uppermost position of movement along pole 24 illustrated in FIG. 2 established by contact against a stop 54, slide 46 is manually moved through descending movement along pole 24 following slide 46 being unlatched from an appropriate and well understood latching/ /unlatching mechanism generally designated 56.

Contemporaneously with descending movement of slide 46, there will be the inward movement 22 previously noted in connection with FIG. 1 of fabric cover component 14 supported on support struts 38. To this end, adjacent the inboard ends 38A of each of the struts 38 there are provided two slides 56A and 56B which can take any appropriate form, the preferred form being U-shaped components of metal construction material, disposed in encircling relation about a cooperating strut 32 and each respectively pivotally connected at the pivots 58 and 60 to each strut end 38A.

As slide 46 partakes of descending movement along the center pole 24, and assumes the position of movement depicted in FIG. 3, it can be readily understood from FIG. 3 that this results in pivotal movement 62 of link 44 relative to its pivotally connected end 44A and also corresponding pivotal movement 64 about pivot 50 which is transmitted to the link end or pivot 44B which, of course, is also a structural feature of each strut 38. Thus, the pivotal movement 64 translates into linear movement 22 of each strut 38 which, of course, is permitted beneath the unattached fabric component 12 supported on the struts 32 as the slides 56A and 56B track along each cooperating strut 32.

Ultimately, and as best shown in FIG. 4, slide 46 is in its lowest descending position of movement because further descending movement is not permitted by virtue of the connection of slide 46 via links 44 and 48 to the center pole pivot 28. As should be readily understood from FIG. 4, the struts 38 have ascended to a position of movement permitted by the tracking of the upper ends of the struts 38 along the struts 32, as shown in FIG. 4. Most significantly, comparing the radial extent of the umbrella fabric covers 12, 14 in the open condition of the umbrella as depicted in FIGS. 1 2 with the extent of the fabric cover as depicted in FIG. 4, it should be noted that in the former the size or dimension of the fabric cover 12, 14 is dimension A plus dimension B, and in the latter it is a more compact size consisting of the dimension A and the lesser dimension B/2. The dimension B/2 will be understood to be approximately one half the dimension B.

It should, of course, be readily appreciated that the smaller dimension or extent of the fabric covers 12, 14 in the closed condition of the umbrella is more suitable by virtue of being more compact for storage of the umbrella, whereas the increased size in the extent of the fabric cover components 12, 14 in the open condition of the umbrella is more suitable during actual use of the umbrella, such use being outdoors on the beach, on a patio, at pool side, in a restaurant, and in other such environments. Additionally, it will be understood that, while the umbrella covers are preferably of fabric construction material, use also effectively can be made of plastic or other construction materials.

The umbrella 10 herein shown and disclosed in detail is to be understood to be fully capable of obtaining the objects and providing the advantages hereinbefore stated. In addition to the advantage of a compact size convenient for storage, there are other advantages as, for example, that in use in a beach environment it has been found that the erect condition of the umbrella 1 is significantly less prone to adverse consequence of wind because of the openings bounded between the outer edge 12B of fabric cover 12 and the inner edge 14A of fabric cover 14, through which the wind harmlessly and without consequence is allowed to pass. Thus, it is to be understood that umbrella 10 as described is merely illustrative of the presently preferred embodiment of the invention and that no limitations are intended to the detail of construction or design herein shown other than as defined in the appended claims.

What is claimed is:

1. An umbrella having an optimum small-sized fabric cover in a closed position and an increased-sized fabric cover in an opened position, said umbrella comprising a center pole having opposite upper and lower ends, a pivot mounted adjacent said center pole upper end, an upper circumferentially disposed first set of struts having opposite upper and lower ends having said upper ends thereof pivotally mounted to said pivot, a first doughnut-shaped fabric cover disposed in covering relation over said first set of struts and having opposite upper and lower edges, said first fabric cover being connected only along said upper and lower edges to said cooperating upper and lower ends of said first set of struts and having a length portion disposed in unconnected relation therebetween, a first slide slidably disposed to track lengthwise of said center pole, a lower circumferentially disposed second set of struts having opposite upper and lower ends operatively disposed in supported relation from said first set of struts so as to be urged through movement from an initial closed position together with said first set of struts against said center pole into an open position extending radially outwardly of said center pole and lengthwise radially of said first set of struts in response to sliding movement of said first slide lengthwise of said center pole, a second doughnut-shaped fabric cover disposed in covering relation over said second set of struts, and a second slide on each said upper end of said second set of struts in encircling relation about a cooperating upper end of each first set of struts so as to adapt said second set of struts to track from an initial position of movement adjacent an end of a first strut along each said first set of struts beneath said unconnected length portion of said first doughnut-shaped fabric cover to a subsequent position of movement adjacent said opposite lower connected edge of said first doughnut-shaped fabric cover, whereby in response to sliding movement of said first slide lengthwise of said center pole said first and second fabric covers simultaneously are urged into radially extending positions from said pivot of said center pole with said second fabric cover serving as a radial extension of said first fabric cover to thereby contribute to an increased-size of fabric covers for said umbrella.

* * * * *